United States Patent [19]

Fraser et al.

[11] 4,236,876

[45] Dec. 2, 1980

[54] MULTIPLE COMPRESSOR SYSTEM

[75] Inventors: Bruce A. Fraser, Manlius; Donald Yannascoli, Fayetteville, both of N.Y.

[73] Assignee: Carrier Corporation, Syracuse, N.Y.

[21] Appl. No.: 61,974

[22] Filed: Jul. 30, 1979

[51] Int. Cl.[3] ..... F04B 23/04

[52] U.S. Cl. ..... 417/250; 417/301

[58] Field of Search ..... 417/244, 250, 281, 301

[56] References Cited

U.S. PATENT DOCUMENTS

| | | | |
|---|---|---|---|
| 2,606,430 | 8/1952 | Pownall . | |
| 3,237,852 | 3/1966 | Shaw . | |
| 3,241,746 | 3/1966 | Shaw | 417/426 |
| 3,243,101 | 3/1966 | Shaw . | |

*Primary Examiner*—Edward L. Roberts

*Attorney, Agent, or Firm*—J. Raymond Curtin; John S. Sensny

[57] ABSTRACT

A multi-compressor system comprising first and second stage motor-compressor units, a low pressure line for transmitting vapor from a source thereof to the first stage unit, an intermediate pressure line for transmitting vapor between the first and second stage units, a high pressure line for transmitting vapor from the second stage unit, and a bypass line for transmitting vapor from the low pressure line to the intermediate pressure line to selectively bypass the first stage unit. The first stage unit includes a first supply of lubricant, a first compressor, and a first lubricant overflow passage for passing overflow lubricant from the first supply thereof into the first compressor. The second stage unit includes a second supply of lubricant, a second compressor, and a second lubricant overflow passage for passing overflow lubricant from the second supply thereof into the second compressor. The low pressure line includes a first section, and a second section extending substantially at a right angle to the first section. The bypass line includes a first bypass section connected to the first section of the low pressure line and extending substantially collinear therewith, and a check valve for preventing vapor flow from the intermediate pressure line to the low pressure line via the bypass line.

5 Claims, 5 Drawing Figures

MULTIPLE COMPRESSOR SYSTEM

DESCRIPTION

Background of the Invention

This invention relates generally to systems employing multiple hermetic or semi-hermetic motor-compressor units. More particularly, the present invention pertains to ensuring that an adequate supply of lubricant is available for each compressor of such a system.

The utilization of hermetically and semi-hermetically sealed motor-compressor units has become increasingly prevalent in recent years, particularly in refrigeration applications wherein the motor-compressor unit is employed to compress a refrigerant vapor. The compressor is generally driven by an electric motor, and the crankshaft of the compressor typically rotates at relatively high speeds. For example, if a two-pole electric motor is employed to drive the crankshaft, the crankshaft conventionally rotates at approximately 3,500 revolutions per minute. As is obvious, at such relatively high operating speeds, proper lubrication of the bearings journaling the crankshaft and of other moving parts of the compressor is highly critical. Any lubrication problem, when operating at these high speeds, may result, for example, in bearing failure, eventually causing complete loss of the compressor.

Generally, lubricant such as oil is stored in a reservoir or sump of a shell of the motor-compressor unit, and an oil pump is employed to pump oil from the sump through the compressor to lubricate the moving parts thereof. Frequently, when a hermetic or semi-hermetic motor-compressor unit is employed in a refrigeration circuit, the lubricating oil is miscible with the refrigerant vapor. A portion of the oil pumped through the compressor becomes entrained with the refrigerant passing therethrough, and the entrained oil circulates through the refrigeration circuit with the refrigerant.

In a refrigeration circuit employing only one motor-compressor unit, the entrained lubricant eventually returns to the shell of the motor-compressor unit, and the shell is provided with a sufficient amount of lubricant to ensure adequate lubrication of the compressor despite the fact that lubricant continuously circulates through the refrigeration circuit. However, lubrication problems may arise in a circuit employing multiple motor-compressor units. More specifically, in such a circuit, lubricant tends to collect in one or more of the units at the expense of the remaining units. This unequal distribution of lubricant may be caused by a number of factors. For example, oil circulates through different compressors at different rates because of manufacturing differences between even nominally identical compressors; and in a circuit employing multiple motor-compressor units, lubricant will tend to collect in the unit having the compressor with the lower oil circulation rate. Moreover, if one unit in the circuit is shut down, oil will not circulate through the compressor of that unit, and oil may collect in the shell of the inactive unit.

As may be appreciated, if oil accumulates in one unit at the expense of the other units, a particular unit may become so deprived of lubricant that the compressor of that unit cannot be properly lubricated. For this reason, systems comprising multiple motor-compressor units often include oil equalization means to prevent an excessive accumulation of lubricant in individual units of the system. Prior art oil equalization arrangements, however, often involve extra piping, or require the units of the system to operate at certain relative heights or pressures. Such arrangements may be costly or involve undesirable constraints on the location, size, or operation of the multi-compressor system.

SUMMARY OF THE INVENTION

In light of the above, an object of the present invention is to improve systems employing multiple hermetic or semi-hermetic motor-compressor units.

Another object of this invention is to ensure that an adequate supply of lubricant is available for each compressor of a system utilizing multiple hermetic or semi-hermetic motor-compressor units.

A further object of the present invention is to improve lubrication arrangements for systems employing multiple motor-compressor units without requiring additional extraneous piping or valving.

Still another object of this invention is to employ the inertia of oil circulating through a multiple compressor system to prevent the oil from entering a motor-compressor unit of the system when the unit is shut down and to increase the oil circulation rate through the compressor of that unit when the unit is operating and oil in the shell of the unit reaches a predetermined level.

These and other objectives are attained with a multi-compressor system comprising first and second stage motor-compressor units, a low pressure line for transmitting vapor from a source thereof to the first stage unit, an intermediate pressure line for transmitting vapor between the first and second stage units, a high pressure line for transmitting vapor from the second stage unit, and a bypass line for transmitting vapor from the low pressure line to the intermediate pressure line to selectively bypass the first stage unit. The first stage unit includes a first supply of lubricant, first compressor means, and a first lubricant overflow passage for passing overflow lubricant from the first supply thereof into the first compressor means. The second stage unit includes a second supply of lubricant, second compressor means, and a second lubricant overflow passage for passing overflow lubricant from the second supply thereof into the second compressor means. The low pressure line includes a first section and a second section extending substantially at a right angle to the first section. The bypass line includes a first bypass section connected to the first section of the low pressure line and extending substantially collinear therewith, and check valve means for preventing vapor flow from the intermediate pressure line to the low pressure line via the bypass line.

A BRIEF DESCRIPTION OF THE DRAWINGS

A DETAILED DESCRIPTION OF THE PREFERRED EMBODIMENT

Figure 1:
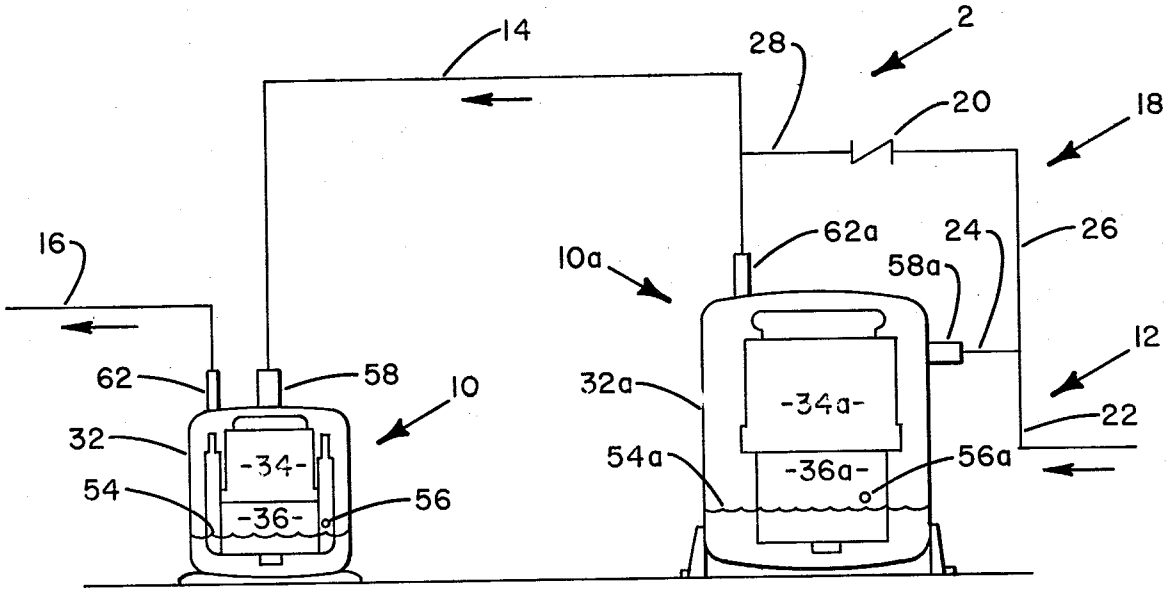
FIG. 1 is a schematic view of a system employing multiple hermetic motor-compressor units and incorporating teachings of the present invention.

Referring particularly to FIG. 1, there is shown a schematic view of system 2 employing multiple hermetic motor-compressor units 10 and 10*a* and incorporating teachings of the present invention. System 2 further comprises low pressure line 12, intermediate pressure line 14, high pressure line 16, bypass line 18, and pressure actuated check valve 20 which is positioned in bypass line 18. Low pressure line 12, in turn, includes first section 22 and second section 24, and bypass line 18 includes first and second bypass sections 26 and 28. As shown in FIG. 1, units 10 and 10*a* are serially arranged, with unit 10*a* operating as a first stage, low pressure unit and unit 10 operating as a second stage, high pressure unit. It should be made clear that, while system 2 includes two motor-compressor units, additional units can easily be added to the system without departing from the scope of the present invention. Moreover, it should be specifically understood that, while illustrated units 10 and 10*a* are discussed below in detail, other types of hermetic and semi-hermetic motor compressor units are well known to those skilled in the art and may be used in the system of the present invention.

Figure 2:
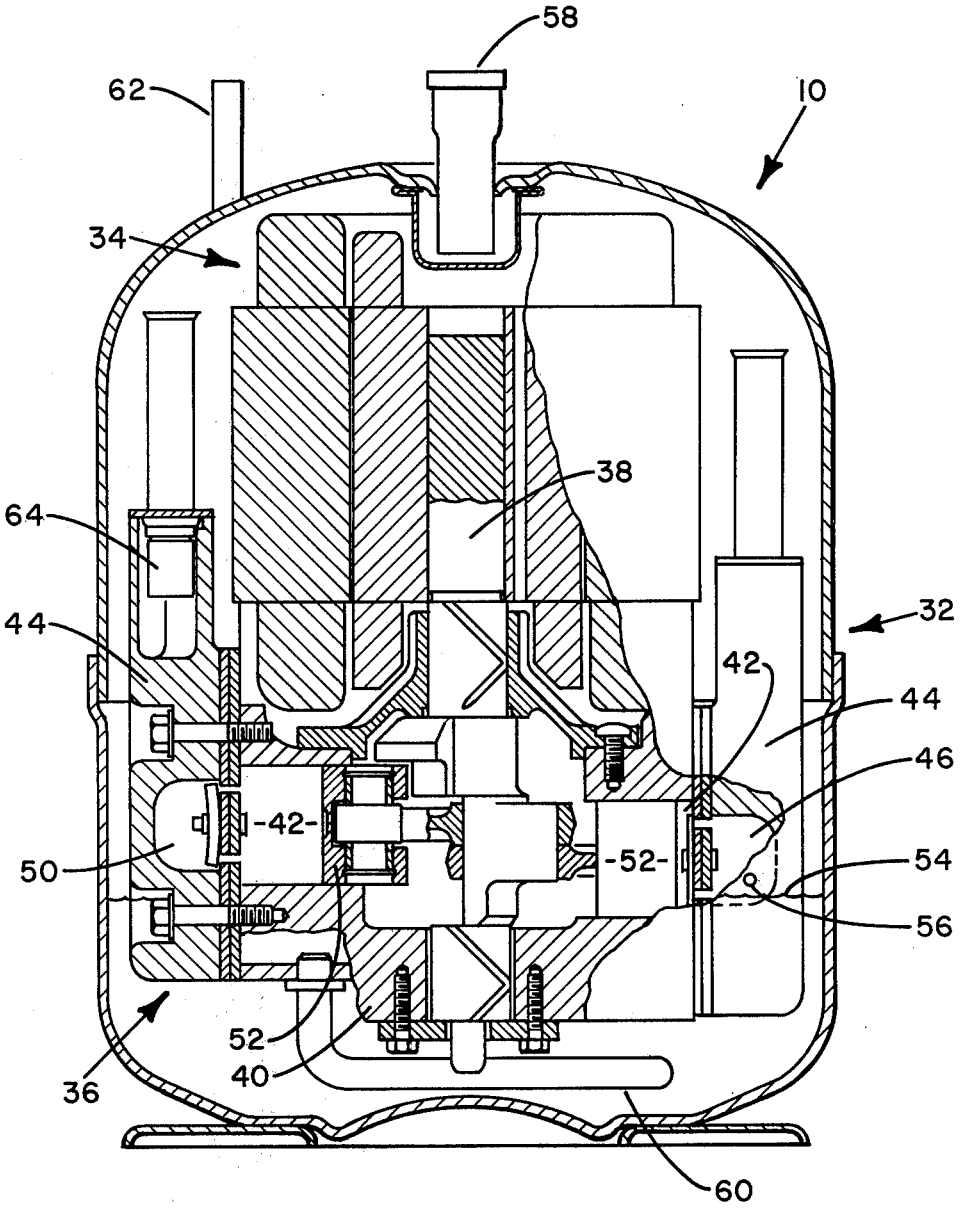
FIG. 2 is a front longitudinal view partly in cross-section of a first hermetic motor-compressor unit shown in FIG. 1.
Figure 3:
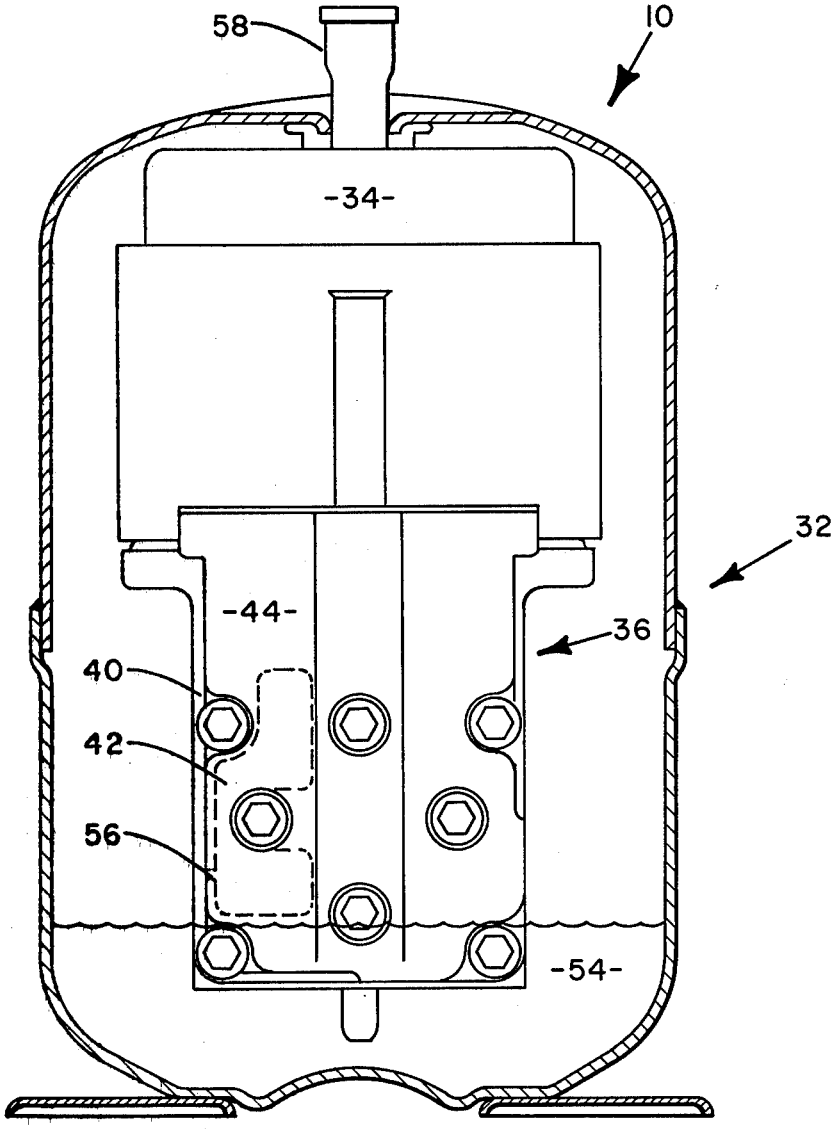
FIG. 3 is a side longitudinal view partly in cross-section of the hermetic unit shown in FIG. 2.

Referring to FIGS. 2 and 3, there are shown, respectively, front and side longitudinal views partly in cross-section of hermetically sealed motor-compressor unit 10. Unit 10 includes casing or shell 32, electric motor 34, and compressor 36, with both the electric motor and the compressor disposed within the shell. In a manner well known in the art, motor 34 is employed to rotate crankshaft 38 which extends downward into compressor 36. Compressor 36 includes cylinder block 40 which defines cylinders 42. Cylinder heads 44 enclose cylinders 42 and define suction plenums 46 and discharge plenums 50. Pistons 52 are located within cylinders 42 for reciprocal movement therein, and the pistons are connected to crankshaft 38 wherein rotation of the crankshaft causes the desired reciprocating movement of the pistons. Supply 54 of lubricant such as oil is stored in a reservoir or sump defined by shell 32, and cylinder head 44 defines lubricant overflow passage 56, discussed in greater detail below.

Figure 4:
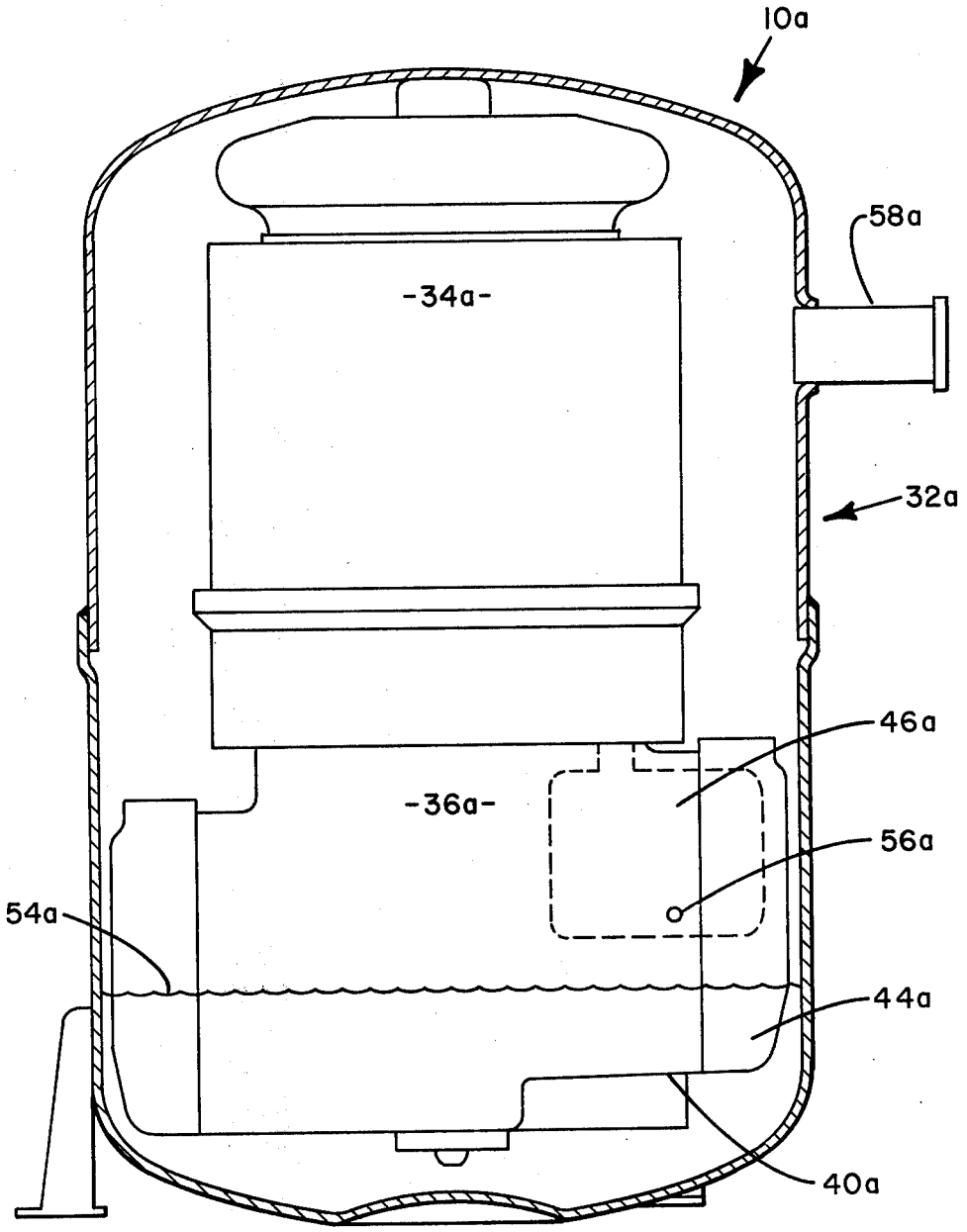
FIG. 4 is a front longitudinal view partly in cross-section of a second hermetic motor-compressor unit shown in FIG. 1.
Figure 5:
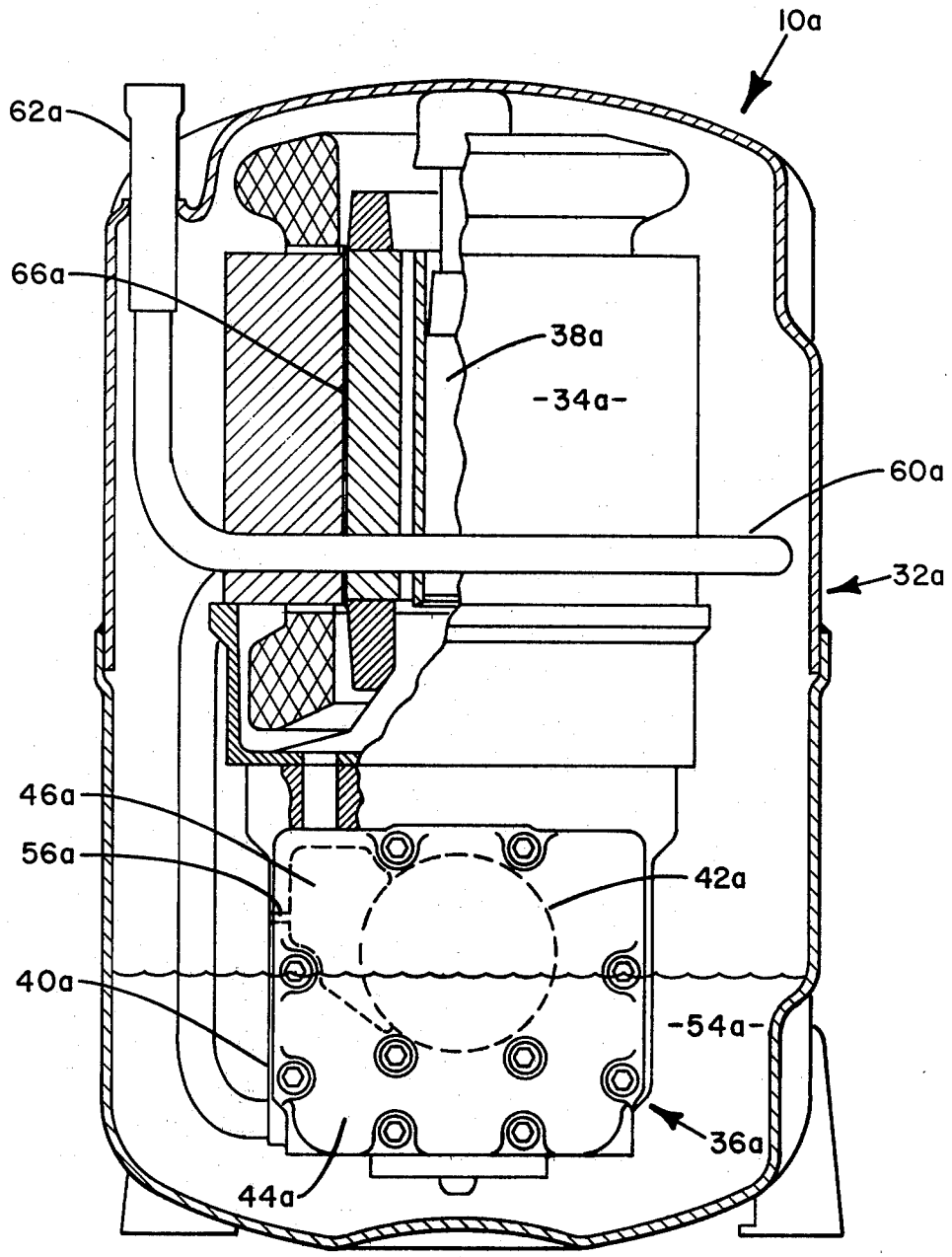
FIG. 5 is a side longitudinal view partly in cross-section of the hermetic unit shown in FIG. 4.

Referring to FIGS. 4 and 5, there are shown, respectively, front and side longitudinal views partly in cross-section of motor-compressor unit 10*a*. As will be appreciated, while units 10 and 10*a* are different, the units have many corresponding parts; and corresponding parts are given like reference numerals, with the numerals associated with unit 10*a* given the suffix "a". Differences between units 10 and 10*a* which should be noted are that, while suction plenums 46 of unit 10 are defined by cylinder head 44, suction plenums 46*a* of unit 10*a* are defined by both cylinder block 40*a* and cylinder heads 44*a*. Further, whereas cylinder head 44 defines lubricant overflow passage 56 of unit 10, cylinder block 40*a* defines lubricant overflow passage 56*a* of unit 10*a*.

System 2 is well adapted for use in a refrigeration or air conditioning circuit. Low pressure refrigerant vapor is conducted from the low pressure, evaporator side of the circuit to first stage unit 10*a* via low pressure line 12. Refrigerant vapor passes through inlet 58*a* and flows over motor 34*a*, cooling the motor. The vapor then enters compressor 36*a*, passes through suction plenums 46*a*, and enters cylinders 42*a*. The refrigerant vapor is compressed therein and discharged therefrom into discharge line 60*a* which connects with discharge outlet 62*a* which, in turn, connects to intermediate pressure line 14.

Intermediate line 14 transmits vapor to second stage unit 10. In a manner similar to that discussed above with respect to unit 10*a*, the vapor is further compressed by compression means 36 of unit 10. High pressure refrigerant is then conducted to the high pressure, condenser side of the refrigeration circuit via high pressure line 16. When unit 10*a* is operating, the pressure difference between low and intermediate pressure lines 12 and 14 closes check valve 20, preventing vapor flow through bypass line 18. When only one compressor is needed to satisfy the requirements of the refrigeration circuit, unit 10*a* is shut down. The pressure in intermediate line 14 falls, opening check valve 20. This allows vapor to pass from low pressure line 12 to intermediate pressure line 14 via bypass line 18, bypassing unit 10*a*.

During normal operation of units 10 and 10*a*, oil from supplies 54 and 54*a* are pumped through, respectively, compressors 36 and 36*a* to lubricate various points or areas of frictional wear throughout the compressors. Numerous types of oil pump mechanisms, for example centrigual force devices, are well known to those skilled in the art and the explanation of their operation is not deemed necessary. As the lubricant flows through compressors 36 and 36*a*, portions of the lubricant become entrained with the refrigerant vapor being compressed by the compressors. The entrained lubricant passes with the refrigerant through the refrigerant circuit.

Lubricant overflow passages or apertures 56 and 56*a* prevent an undesirable accumulation of lubricant in active motor-compressor units of system 2. Under normal operating conditions, lubricant overflow passages 56 and 56*a* are above the surfaces of lubricant supplies 54 and 54*a* respectively. However, referring now to FIGS. 1, 2, and 3, if lubricant collects in supply 54, reducing the amount of lubricant in supply 54*a*, and the level of supply 54 rises to aperture 56, then lubricant flows from supply 54, through aperture 56, and directly into suction plenum 46. This increases the oil circulation rate through compressor 36. By increasing the oil circulation rate through compressor 36, the amount of oil which becomes entrained in the refrigerant vapor flowing therethrough is increased. The amount of oil which passes from shell 32 to shell 32*a* with the refrigerant passing therebetween increases, increasing the amount of lubricant in shell 32*a*. Analogously, referring now to FIGS. 1, 4, and 5, if lubricant collects in supply 54*a*, reducing the amount of lubricant in supply 54, and the level of supply 54*a* rises to passageway 56*a*, then lubricant flows from supply 54*a*, through aperture 56*a*, and directly into suction plenum 46*a*. The oil circulation rate through compressor 36*a* increases, and the amount of oil which becomes entrained in the refrigerant passing through compressor 36*a* also increases. As a result, the amount of oil passing between units 10 and 10*a* with the refrigerant vapor passing therebetween increases, and the amount of lubricant in shell 32 increases.

Preferably, the pressure within suction plenum 46 is less than the pressure within shell 32 and, similarly, the pressure within plenum 46*a* is less than the pressure within shell 36*a*. This pressure difference prevents vapor from passing out of low pressure plenums 46 and 46*a* via lubricant passages 56 and 56*a* and assists lubricant flow into the low pressure plenums through the lubricant overflow passages. Referring to FIGS. 2 and 3, in unit 10 this pressure difference is caused, inter alia, by a pressure drop in the vapor as it passes through mufflers 64 which are located within cylinder heads 44. Referring to FIGS. 4 and 5, in unit 10*a* this pressure difference is caused, again inter alia, by a reduction in the pressure of vapor as it passes through passages 66*a* of motor 34*a*.

As discussed above, lubricant overflow passages 56 and 56*a* effectively prevent an undesirable accumulation of lubricant in the active motor-compressor units of system 2. The unique design of system 2 also effectively prevents an unwanted accumulation of lubricant in inactive units. More particularly, low pressure line 12 and bypass line 18 are specifically designed to prevent lubricant from entering unit 10*a* when that unit is shut down. Referring to FIG. 1, low pressure line 12 includes first section 22 for conducting vapor from the source thereof, and second section 24 connected to the first section for conducting vapor therefrom and extending substantially at a right angle thereto. Bypass line 18 includes first bypass section 26 connected to first section 22 of low pressure line 12 for conducting vapor therefrom and extending substantially collinear therewith.

With the above-discussed piping arrangement, the momentum of the refrigerant vapor and entrained lubricant passing through first section 22 of low pressure line 12 tends to carry the refrigerant and lubricant past second section 24 of the low pressure line and directly into first bypass section 26. When check valve 20 is closed, which occurs when unit 10*a* is active, the check valve prevents vapor and lubricant from passing through bypass line 18. The refrigerant vapor and entrained lubricant is forced through second section 24 of low pressure line 12 and into shell 32*a* via inlet 58*a* thereof, providing lubricant for compressor 36*a*. However, when check valve 20 is open, which occurs when unit 10*a* is inactive, vapor and lubricant are free to pass through bypass line 18. The inertia of the lubricant entrained with refrigerant vapor passing through first section 22 of low pressure line 12 urges the lubricant to continue moving along a straight line and, thus, causes the lubricant to flow into first bypass section 26, which is collinear with first section 22, and prevents the lubricant from entering second section 24 of low pressure line 12, which extends substantially at a right angle to first section 22. The lubricant flows from first bypass section 26 into intermediate pressure line 14 via second bypass section 28. The lubricant does not enter shell 32*a* and, of course, does not accumulate therein, ensuring an adequate supply of lubricant for active compressor 36.

Thus, the system shown in FIG. 1 is well adapted to ensure an adequate supply of lubricant for the compressors of the system whether all the motor-compressor units are operating or some are inactive. Specifically, the lubricant overflow passageways prevent lubricant from accumulating in active units; and the unique arrangement of the low pressure and bypass lines prevents lubricant from entering, and thus accumulating, in the inactive units. Moreover, as a review of the drawings and the above discussion will disclose, Applicants' unique system achieves this very beneficial result without requiring additional extraneous piping or pumping apparatus and without requiring, as examples, that the motor-compressor units be arranged at specific relative heights or operate at certain pressures. In contrast, the system described above is a reliable and inexpensive arrangement for ensuring an adequate supply of lubricant for each compressor of a multiple compressor system.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

We claim:

1. A multi-compressor system comprising:

a first stage motor-compressor unit including a first shell, a first supply of lubricant disposed therein, first compressor means for compressing a vapor, first motor means for driving the first compressor means, and a first lubricant overflow passage communicating the interior of the first compressor means with the first lubricant supply for passing lubricant therefrom into the first compressor means when the first lubricant supply reaches a predetermined level;

a second stage motor-compressor unit including a second shell a second supply of lubricant disposed therein, second compressor means for compressing the vapor, second motor means for driving the second compressor means, and a second lubricant overflow passage communicating the interior of the second compressor means with the second lubricant supply for passing lubricant therefrom into the second compressor means when the second lubricant supply reaches a predetermined level;

a low pressure line including a first section for transmitting vapor from a source thereof, a second section connected to the first section for transmitting vapor therefrom and extending substantially at a right angle thereto, and means connecting the second section to the first shell wherein vapor passes therein from the second section;

an intermediate pressure line for transmitting vapor from the first shell to the second shell;

a high pressure line for transmitting vapor from the second shell; and a bypass line connecting the low pressure line with the intermediate pressure line for selectively bypassing the first shell and including a first bypass section connected to the first section of the low pressure line for transmitting vapor therefrom and extending substantially collinear therewith, means connecting the first bypass section with the intermediate pressure line wherein vapor passes thereto from the first bypass section, and valve means for preventing vapor flow from the intermediate pressure line to the low pressure line via the bypass line.

2. The multi-compressor system as defined by claim 1 further including means for preventing vapor from passing out of the first and second compressor means via the first and second lubricant overflow passages.

3. The multi-compressor system as defined by claim 2 wherein:

the first compressor means includes cylinder block means, and the first lubricant overflow passage is defined by the cylinder block means; and the second compressor means includes cylinder head means, and the second lubricant overflow passage is defined by the cylinder head means.

4. The multi-compressor system as defined by claim 3 wherein the preventing means includes means for reducing the pressure of vapor passing into the first and second compressor means.

5. The multi-compressor system as defined by claim 4 wherin the reducing means includes:

muffler means disposed within the second compressor means; and vapor passages extending through the first motor means.

* * * * *